US006368200B1

(12) United States Patent
Merchant et al.

(10) Patent No.: US 6,368,200 B1
(45) Date of Patent: Apr. 9, 2002

(54) POLISHING PADS FROM CLOSED-CELL ELASTOMER FOAM

(75) Inventors: Sailesh Mansinh Merchant; Sudhanshu Misra; Pradip Kumar Roy, all of Orlando, FL (US)

(73) Assignee: Agere Systems Guardian Corporation, Allentown, PA (US)

( * ) Notice: Subject to any disclaimer, the term of this patent is extended or adjusted under 35 U.S.C. 154(b) by 0 days.

(21) Appl. No.: 09/516,836

(22) Filed: Mar. 2, 2000

(51) Int. Cl.[7] ..... B24D 11/00
(52) U.S. Cl. ..... 451/527; 451/533
(58) Field of Search ..... 451/526, 527, 451/528, 529, 530, 533, 538

(56) References Cited

U.S. PATENT DOCUMENTS 5,297,364 A * 3/1994 Tuttle ..... 51/209 R
5,904,615 A 5/1999 Jeong et al.
6,120,353 A * 9/2000 Suzuki et al. ..... 451/41

* cited by examiner

*Primary Examiner*—Timothy V. Eley
*Assistant Examiner*—Dung Van Nguyen
(74) *Attorney, Agent, or Firm*—Christie, Parker & Hale, LLP

(57) ABSTRACT

A polishing pad formed from closed-cell elastomer foam includes a population of bubbles within the pad. As the pad wears due to polishing and the polishing surface recedes, the freshly formed polishing surface includes pores formed of the newly exposed bubbles. The pores receive and retain polishing slurry and aid in the chemical mechanical polishing process. Pad conditioning is not required because new pores are constantly being created at the pad surface as the surface recedes during polishing. The method for forming the polishing pad includes the injection of gas bubbles into the viscous elastomer material used to form the pad. Process conditions are chosen to maintain gas bubbles within the elastomer material during the curing and solidifying process steps.

7 Claims, 2 Drawing Sheets

POLISHING PADS FROM CLOSED-CELL ELASTOMER FOAM

FIELD OF THE INVENTION

The present invention relates most generally to the semiconductor manufacturing industry and more particularly to the polishing pads used in chemical mechanical polishing tools used in the semiconductor manufacturing industry.

BACKGROUND OF THE INVENTION

Chemical mechanical polishing (CMP) operations are widely used in the semiconductor manufacturing industry for polishing film structures during the fabrication of semiconductor devices. A chemical mechanical polishing operation is generally used for several operations during the fabrication of each semiconductor device. Consumable costs associated with CMP operations represent an ever-increasing portion of total production costs associated with the semiconductor manufacturing industry. An example of such a consumable item is the polishing pads used in CMP tools for polishing semiconductor substrates.

A chemical mechanical polishing process may be accomplished by an abrasive slurry lapping process in which a semiconductor wafer mounted on a rotating carrier is brought into contact with a rotating polishing pad upon which is introduced a slurry of insoluble abrasive particles suspended in a liquid. The slurry may additionally be acidic or basic in nature. As such, CMP is accomplished using both mechanical abrasion and chemical action. Material is removed from the semiconductor wafer surface due to both the mechanical buffing action and the chemical action of the acid or base.

Various CMP tools are known in the art. A typical CMP tool includes a rotatable circular polishing platen having a circular polishing pad mounted thereon. A rotatable polishing head or carrier adapted for holding and often rotating a substrate such as a semiconductor wafer is suspended over the platen. The carrier and platen are rotated by separate motors. The slurry is introduced onto the polishing pad surface. The semiconductor wafer held by the carrier is brought into contact with the pad and is polished due to the mechanically abrasive action of the abrasive particles and the chemical action of the slurry. The polishing pad includes an upper portion typically formed of a urethane material consisting of, for example, a flexible non-woven fabric impregnated with foamed urethane. Such a urethane pad has a plurality of fine voids at the pad surface. The voids typically extend perpendicularly away from the polishing pad surface and create pores at the pad surface. The voids typically extend perpendicularly through the upper portion of the polishing pad. The slurry is received and retained in these pores, enabling the pad to chemically and mechanically polish the semiconductor wafer. The polishing pad also includes a lower portion formed of a spongy, resilient material.

During the CMP process used to polish the wafer surface, upright sharp points on the surface of the pad may be worn, compressed, or depressed by the pressure applied from the wafer to the pad and any motion imparted upon the wafer. The voids of the pad may also be plugged with the mixture of slurry and solid wafer material separated from the wafer surface due to the wear of the surface as a result of the polishing. In this manner, a glazing phenomenon occurs on the pad surface.

When the voids on the surface of the pad become plugged, it is difficult for the pad to hold the slurry. The degree of pad pore saturation is reduced. This, along with the wearing of sharp points on the surface of the pad, degrades wafer polishing efficiency and repeatability as well as the uniformity of the polished wafer surface. In order to solve such a problem, the polishing pad surface is typically conditioned by being ground at the surface using a diamond coated disk after being used for several wafers or tens of wafers. The conditioning process removes a surface layer laminated upon the pad and counteracts the glazing phenomenon which occurs. That is, a fresh new pad surface is periodically formed by the conditioning process. The freshly formed pad surface formed by the conditioning process includes a desired and consistent degree of pad roughness, and includes open pores capable of receiving and retaining the slurry. As such, the conditioning process is periodically and regularly carried out.

The conditioning process, however, includes the following limitations. Diamond grains may separate from the diamond disk during the conditioning of the pad and form scratches on the surface of a wafer being polished. Additionally, the pad and wafers may be contaminated by metal grains separated from the disk on which the diamonds are disposed. Furthermore, the conditioning processes themselves can be time consuming and also result in a yield degradation.

Moreover, each time the pad is conditioned, a large amount of the pad material is removed. As a result, the lifetime of the consumable polishing pad is shortened due to multiple conditioning operations being carried out. The consumable polishing pad is a costly item. Additionally, when the consumable polishing pad is replaced, the CMP tool is unavailable for production use. The maintenance procedure used to replace the polishing pad may be time consuming and will often require that extensive and time-consuming warm-up procedures are conducted subsequent to pad replacement. As a result of the time required to replace the pad and to carry out the subsequent warm-up procedures required, the CMP tool is unavailable for an extended time. This results in a further yield degradation.

As such, it can be seen that what is desired in the art is a polishing pad which includes an extended lifetime, does not require frequent replacement, and maintains a consistent polishing surface having the same degree of roughness and including pores which retain the polishing slurry and therefore promote a consistent and uniform removal rate, a good planarizing ability, and a reliable, repeatable and efficient polishing process.

SUMMARY OF THE INVENTION

To meet these and other needs, and in view of its purposes, the present invention provides a polishing pad for use in a chemical mechanical polishing tool and a method for forming the same. The upper portion of the polishing pad is a closed-cell elastomer. The upper portion includes bubbles contained therewithin. Because of the random distribution of even sized bubbles within the elastomer material, conditioning is not required as new bubbles are continuously exposed as the pad wears out during polishing. The newly exposed bubbles at the polishing surface are capable of receiving and retaining the polishing slurry. The present invention also provides a method for forming the polishing pad by introducing gas bubbles into the fluid elastomer material which will form the polishing pad. Process conditions are chosen to maintain the bubbles within the elastomer material, as the elastomer material is formed into a solid cake from which individual polishing pads will be formed by slicing.

DETAILED DESCRIPTION OF THE INVENTION

The present invention is directed to a polishing pad for use in a CMP tool, and a method for forming the same. The upper portion of the polishing pad formed according to the present invention, including the polishing surface, is a closed-cell elastomer including a plurality of bubbles formed within the upper portion of the polishing pad. The bubbles are randomly distributed. As the polishing pad wears due to polishing semiconductor wafers or the like, the polishing surface recedes and new bubbles are continuously exposed. The bubbles are adapted to receive the polishing slurry used in the CMP process. Conventionally available polishing pads include pores which extend down from the polishing surface and generally through the entire thickness of the upper portion of the polishing pad. When these pores become plugged with material produced as a result of the polishing process, and forced within the pores due to the force used to press the surface to be polished against the polishing pad, the pores are unavailable to receive and retain polishing slurry as required. Therefore, a conditioning process is required which intentionally removes a portion of the polishing surface to produce a fresh polishing surface including open pores. An aspect of the present invention is that such a conditioning process is not required.

Figure 1:
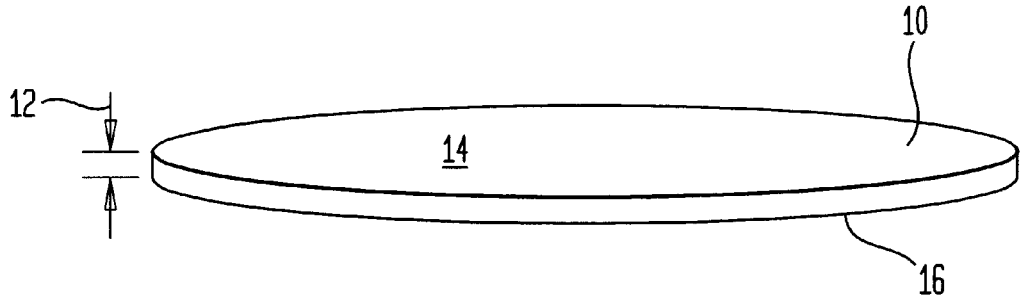
FIG. 1 is a perspective view of a polishing pad according to the present invention.

FIG. 1 is a perspective view showing an upper portion of a polishing pad formed according to the present invention. It should be understood that, prior to being installed in a CMP tool, the upper portion of the polishing pad shown in FIG. 1 will be mounted over a spongy lower portion of a polishing pad (not shown) before the polishing pad is installed onto the platen on which it will be used in the CMP tool. The present invention is directed to providing an improved upper portion of the polishing pad, including the polishing surface, and a method for forming the same. As such, the upper portion of the polishing pad shown in FIG. 1, will hereinafter simply be referred to as the polishing pad 10. Polishing pad 10 is a generally circular pad according to the exemplary embodiment. Polishing pad 10 is shaped and sized to be seated on a platen within a CMP tool. According to various other exemplary embodiments, the pad may take on different configurations. Polishing pad 10 includes an upper, polishing surface 14 and a thickness 12. It should be emphasized, once again, that thickness 12 is the thickness of the upper portion of a composite polishing pad. Polishing pad 10 includes a bottom 16 which will generally be joined to a spongy, lower polishing pad portion (not shown) using an adhesive. Polishing pad 10 includes thickness 12 which may be on the order of 50–100 mils thick, but other pad thicknesses may be used.

Figure 2:
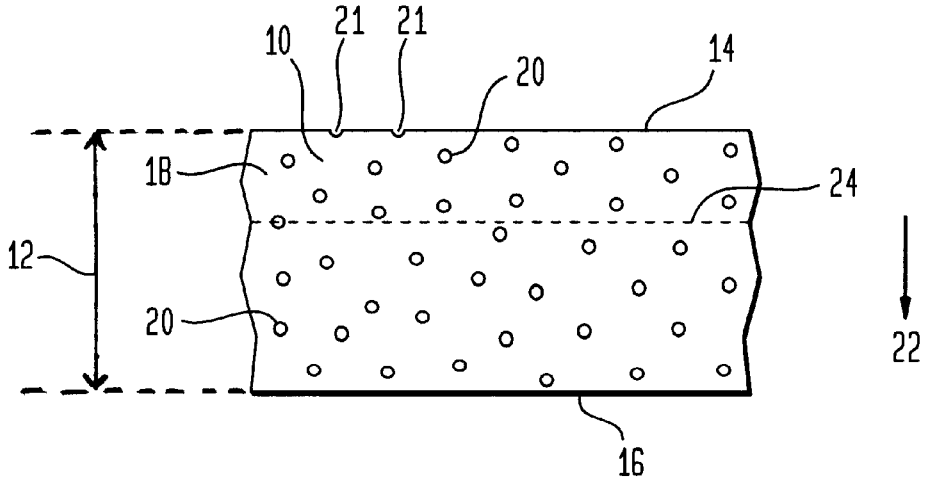
FIG. 2 is an expanded cross-sectional view of the polishing pad shown in FIG. 1.

FIG. 2 is an expanded cross-sectional view of a portion of the polishing pad formed according to the present invention. Polishing pad 10 includes top, polishing surface 14 and bottom 16. Thickness 12 may be on the order of 50–100 mils, for a new and unused polishing pad. Polishing pad 10 includes a population of bubbles 20 formed within material 18. Polishing pad material 18 may be a polymer, typically an elastomer such as polyurethane. According to various exemplary embodiments, other polymeric materials, and elastomers other than polyurethane, may be used. It can be seen that bubbles 20 are formed randomly, yet uniformly within polishing pad 10. By this description it is meant that, although random in distribution, a horizontal cross section of pad 10 taken at any of various locations along direction 22 is likely to have the same density of bubbles formed across the cross-sectional cut. Top surface 14 is the polishing surface which physically contacts the surface being polished, and onto which the polishing slurry (not shown) is introduced.

When bubbles 20 intersect with the exposed polishing surface 14, voids 21 result. When a polishing slurry which typically contains insoluble abrasive particles suspended in a liquid which may be either an acid or a base, is introduced onto polishing surface 14, voids 21 act to receive and retain the polishing slurry. It is necessary to maintain some of the polishing slurry on polishing surface 14 and between polishing surface 14 and the surface being polished. Alternatively stated, a high degree of pad pore saturation must be desirably maintained. As such, it can be understood that voids 21 which receive and retain the polishing slurry, are required for efficient, uniform and repeatable polishing processes.

Bubbles 20 may include a diameter ranging from 0.5 to 5.0 millimeters. According to various exemplary embodiments, and according to the method and conditions used to form polishing pad 10, the population of bubbles 20 may contain bubbles having essentially the same size, or they may consist of a range of different bubble sizes.

During the polishing operation, the polishing pad 10 wears, and polishing surface 14 recedes along direction 22. It can be therefore understood that, after the polishing pad is used for multiple polishing operations, original polishing pad surface 14 may recede to form polishing pad surface 24 shown by the dashed line. It can be seen that polishing pad surface 24 is also intersected by a representative population of bubbles 20 which, once polishing pad surface 24 is exposed, will form voids along surface 24 (similar to voids 21 along polishing pad surface 14).

Figure 3:
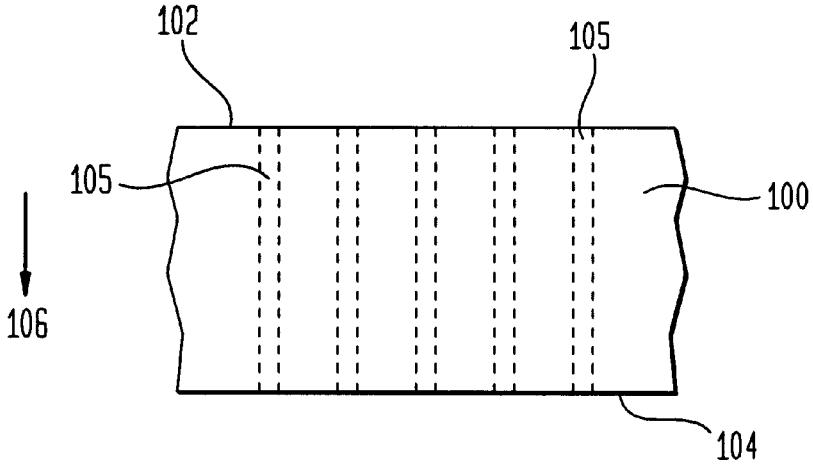
FIG. 3 is a cross-sectional view of a polishing pad as in the prior art.

FIG. 3 is a cross-sectional view of a section of a polishing pad according to the prior art. It can be seen that polishing pad 100 includes pores 105 which extend from top polishing surface 102 completely through the pad to bottom 104. When polishing surface 102 is forced against a surface to be polished (not shown) and a polishing operation is carried out, polished solid materials removed from the substrate being polished can become lodged within pores 105, thereby plugging pores 105. The pressure applied to force polishing pad surface 102 against the surface being polished, may force a material which is lodged into pores 105, downward beneath polishing surface 102 and into deeper recesses of the polishing pad 100. As can be seen, pores 105 extend generally perpendicularly away from polishing surface 102. As the polishing process continues and polishing surface 102 recedes along direction 106, the continuous force applied to effectuate the polishing operation continues to force the materials lodged into pores 105 as well as new materials, deeper into the polishing pad. As such, pores 105 remain permanently plugged and are unavailable to receive and retain polishing slurry.

In order to preclude this phenomenon from occurring and adversely affecting the polishing efficiency, a conditioning process is regularly performed on the polishing surface. The conditioning process typically grinds the polishing surface using a diamond disk to remove an upper portion of the polishing surface and to produce a fresh polishing pad surface having the same characteristics as the original polishing pad surface which includes opened pores capable of receiving and retaining a polishing slurry and the same degree of roughness. The fresh polishing pad surface may additionally include upright sharp points which are included on the original surface. The shortcomings of the conditioning process are as described above and include that the pad surface is recessed considerably during the conditioning process, drastically reducing the pad lifetime.

Furthermore, if pores 105 are plugged with material deep into the pad, the conditioning process may not produce open pores at the polishing surface.

It is an aspect of the present invention that such a conditioning process is not required. This is so because, as the pad surface is recessed and the pad is worn during polishing operations, new bubbles are constantly being exposed as the new polishing surface forms. In this manner, voids which are the product of the intersection of bubbles with the pad surface, are constantly available for receiving and retaining the polishing slurry.

Figure 4:
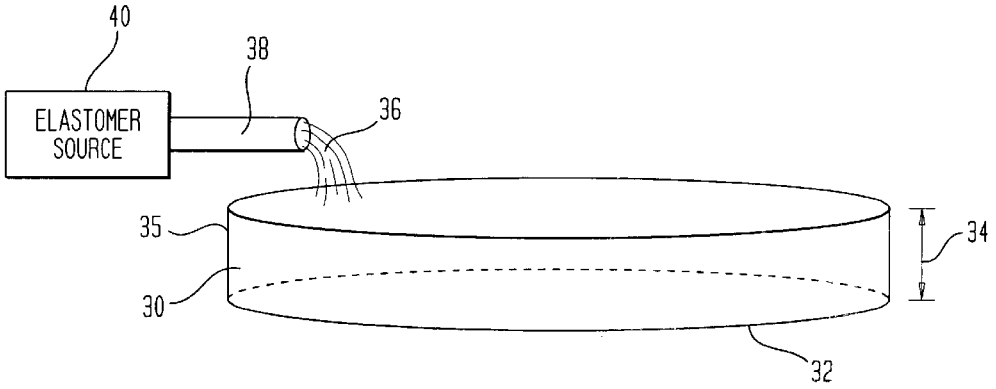
FIG. 4 is a perspective view of a mold used to form the polishing pad according to the present invention.

The present invention also discloses a method for forming the polishing pad including a plurality of bubbles therewithin. The method of formation includes introducing a fluid elastomer material into a mold shaped to form a cake from which the polishing pad is formed. Any suitable method for molding, such as injection molding, may be used. FIG. 4 is a perspective view showing a mold 30 capable of receiving a liquid polymer 36 which is delivered to the mold from elastomer source 40 by way of delivery system 38. It should be understood that the apparatus shown in FIG. 4 is exemplary only. Various other methods for introducing a liquid polymer material into a mold shaped to form a cake from which polymer pads will be formed, may be used. The pad may be molded using various injection molding techniques such as a gas assisted injection molding or reaction injection molding. The molding may be done from the top or from the side, and the mold may be a closed member having an inlet port through which the molding material is introduced.

The polishing pad formed according to the present invention may be formed of various liquid polymers, typically elastomers such as polyurethane, but other elastomers and liquid polymers may be used alternatively. The viscous polymer 36 from elastomer source 40 is introduced into mold 30 by means of delivery system 38. It should be emphasized that this point that various other systems for delivering a viscous elastomer into mold 30 may be used. Mold 30 includes a bottom 32 and a height 34. Mold 30 also includes outer walls 35 and may be generally round in the horizontal direction. Regardless of the specific molding method used, once viscous polymer 36 is introduced into mold 30, a fluid elastomer cake is formed within mold 30.

Figure 5:
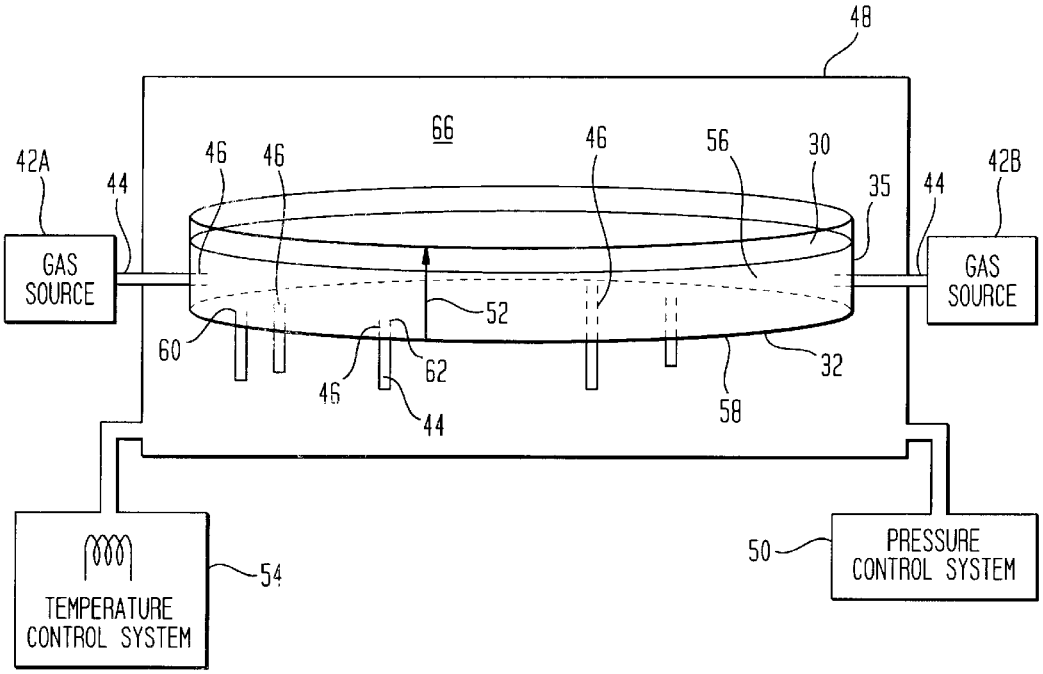
FIG. 5 is a perspective view of an exemplary apparatus, including a mold, used to form the polishing pad according to the present invention.

Elastomer cake 56 can be seen in FIG. 5. FIG. 5 is a perspective view of an exemplary apparatus used to form the polishing pad according to the present invention, after an elastomer material is introduced into mold 30 as shown in FIG. 4. Referring now to FIG. 5, elastomer cake 56 is formed within mold 30. Elastomer cake 56 includes bottom 58 which forms along bottom 32 of mold 30. After elastomer cake 56 is initially formed as above, and is in a viscous, or fluid state, gas bubbles are introduced from gas sources 42*a* and 42*b* through tubes 44. It should be understood that multiple gas tubes 44 may be connected to a single gas source. Gas tubes 44 abut the inner surface of mold 30 to form various inlet ports 46. A plurality of inlet ports 46 are included at various locations along outer wall 35 and are disposed along various locations along vertical direction 52. In addition, inlet ports 46 will include multiple locations, for example, locations 60 and 62, along bottom 32 of mold 30. In this manner, bubbles may be introduced into the viscous elastomer cake 56 at various locations. According to the preferred embodiment, the gas introduced into elastomer cake 56 and which forms the bubbles, may be air or nitrogen.

It is an aspect of the present invention to maintain bubbles within elastomer cake 56 during the formation process. Various methods may be used to achieve this. For example, elastomer cake 56 may be maintained within chamber 48 as in the exemplary embodiment. Chamber 48 may be maintained at a desired pressure by pressure control system 50. The temperature within chamber 48 may also be maintained by temperature control system 54. When elastomer cake 56 is in viscous form, and bubbles such as air bubbles are being introduced by gas sources 42*a* and 42*b* at inlet ports 46, the vapor pressure within chamber 48 may be maintained so as to prevent bubbles from escaping the elastomer cake 56.

Bubbles are maintained within fluid elastomer cake 56 by maintaining the vapor pressure of atmosphere 66, above fluid elastomer cake 56 within chamber 48, at a pressure greater than the partial pressure of the bubbles within fluid elastomer cake 56. Various means for maintaining such a suitably high vapor pressure so as to maintain bubbles within the elastomer cake, may be used. For example, the following various conditions may be collectively controlled to maintain bubbles within fluid elastomer cake pad 56: the temperature within the chamber (controllable via temperature control means 54); the flow rate and pressure of the gas being introduced via inlet ports 46; the size and number of inlet ports 46; and, the vapor pressure of atmosphere 66.

According to other exemplary embodiments, conventional surfactants, or other suitable additives or chemicals such as forming agents, may be added to elastomer cake 56 to promote the maintenance of bubbles within the elastomer cake 56. Alternatively stated, various means may be used to prevent the formed bubbles from escaping from elastomer cake 56.

The size, density and size distribution of the bubbles being formed and maintained within fluid elastomer cake 56 may be controlled by the various processing conditions also used to insure that the bubbles are maintained within the pad. Examples of such conditions include the flow rate of the gas being introduced into fluid elastomer cake 56, the uniformity of the flow rate of the gasses being introduced into fluid elastomer cake 56, the size and number of inlet ports 46, and the temperature and pressure maintained within chamber 48. Various other processing conditions may be monitored and controlled to produce a bubble population within elastomer cake 56, having various sizes, uniformities, and densities.

During and after the process of injecting gas into fluid elastomer cake 56, elastomer cake 56 is cured by heating. According to one exemplary embodiment, the heating may occur within mold 30 and within pressure control chamber 48. According to another exemplary embodiment, mold 30 containing viscous elastomer cake 56 may be heated and cured in a further oven (not shown). The heating and curing process may take place at a temperature within the range of 225–275° C., but other temperatures may be used alternatively. The curing process effectuates the polymerization of the elastomer cake material by causing molecular cross-linking of a polymer material. The curing/heating process also drives off solvent from elastomer cake 56.

As the curing process occurs, elastomer cake 56 begins to solidify. During this heating and solidifying process, the vapor pressure above elastomer cake 56 and the temperature ramp-up are chosen to ensure that, while the solvent within elastomer cake 56 is driven off and cross-linking occurs within the polymeric material, bubbles are maintained within elastomer cake 56.

After a sufficient curing time has been allocated to ensure cross-linking of the polymeric materials, the solidified elastomer cake 56 is then cooled. Conventional cooling means may be used to actively cool elastomer cake 56, or elastomer cake 56 may be allowed to cool in the ambient environment. In either case, as the solidification progresses, bubbles are maintained within solidifying elastomer cake 56.

It should be emphasized that, during each of the curing/heating and cooling processes, conditions such as temperature and vapor pressure, are chosen to ensure that a significant population of the bubbles introduced into elastomer cake 56, are maintained within elastomer cake 56. During the heating and cooling processes, however, some bubbles may escape elastomer cake 56.

According to various exemplary embodiments, the processing conditions during the formation of the viscous, then solid, elastomer cake 56 may be chosen to produce a random, or uniform distribution of bubbles within elastomer cake 56. By controlling processing conditions as described above, bubble sizes and densities may also be controlled. The bubbles may include similar size throughout the elastomer cake 56 or they may include a range of bubble diameters. Bubble diameters may range from 0.5–5.0 millimeters according to various exemplary embodiments. According to the exemplary embodiment as described in conjunction with FIG. 2, the distribution of bubbles may be random yet uniform in the sense that, as the pad wears and the polishing surface recedes, the freshly formed polishing surface will include approximately the same density of bubbles at the new surface.

According to the exemplary embodiment, elastomer cake 56 may be formed to a thickness 64 which may be on the order of 2500–5000 mils. According to other alternative embodiments, different thicknesses may be used. After the elastomer cake is sufficiently cooled and solidified, the formed elastomer cake 56 is sliced into thin horizontal sections of approximately 50–100 mils thickness, which are then used as individual polishing pads. These individual polishing pads are typically secured above a spongy lower pad section before the composite pad is introduced into a CMP tool to be used for polishing.

The preceding merely illustrates the principles of the invention. It will thus be appreciated that those skilled in the art will be able to devise various arrangements which, although not explicitly described or shown herein, embody the principles of the invention and are included within its spirit and scope. Furthermore, all examples and conditional language recited herein are principally intended expressly to be only for pedagogical purposes and to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents such as equivalents developed in the future, i.e., any elements developed that perform the same function, regardless of structure. The scope of the present invention, therefore, is not intended to be limited to the exemplary embodiments shown and described herein. Rather, the scope and spirit of the present invention is embodied by the appended claims.

As such, the invention is not intended to be limited to the details shown. Rather, various modifications and additions may be made in the details within the scope and range of equivalents of the claims and without departing from the invention.

What is claimed:

1. A polishing pad for use in a chemical mechanical polishing apparatus, the polishing pad comprising a lower resilient portion and an upper polishing portion formed of an elastomer material, the upper polishing portion including a top and bottom and including a plurality of generally spherical bubbles therein, the bubbles uniformly distributed throughout the entire upper polishing portion from the top to the bottom.

2. The polishing pad as in claim 1, wherein bubbles of the plurality of bubbles are each substantially the same size.

3. The polishing pad as in claim 1, wherein the plurality of bubbles are randomly distributed within the upper polishing portion.

4. The polishing pad as in claim 1, wherein the elastomer material comprises polyurethane.

5. The polishing pad as in claim 1, wherein a density of the plurality of bubbles is substantially the same throughout the upper polishing portion, along a direction extending from the top to the bottom.

6. The polishing pad as in claim 1, wherein bubbles of the plurality of bubbles have an average diameter of about 2 millimeters.

7. The polishing pad as in claim 1, wherein the plurality of bubbles includes bubbles having diameters ranging from 0.5 millimeters to 4.0 millimeters.

* * * * *